United States Patent [19]

Cardin

[11] 4,332,380

[45] Jun. 1, 1982

[54] MUSCLE BUILDING APPARATUS FOR DEVELOPING BENDING STRENGTH

[76] Inventor: Pierre J. Cardin, 3272 Top View Ct., West Linn, Oreg. 97068

[21] Appl. No.: 193,640

[22] Filed: Oct. 3, 1980

[51] Int. Cl.[3] ..... A63B 21/02

[52] U.S. Cl. ..... 272/137; 272/67; 272/142

[58] Field of Search ..... 272/126, 142, 143, 135, 272/137, 67, 68

[56] References Cited

U.S. PATENT DOCUMENTS

| | | | |
|---|---|---|---|
| 610,716 | 9/1898 | Marshall | 272/135 |
| 2,806,699 | 9/1957 | Spooner | 272/67 X |
| 3,451,675 | 6/1969 | Burzenski | 272/137 |

FOREIGN PATENT DOCUMENTS

| | | | |
|---|---|---|---|
| 2245272 | 3/1974 | Fed. Rep. of Germany | 272/143 |
| 2587 | of 1899 | United Kingdom | 272/135 |
| 526253 | 9/1940 | United Kingdom | 272/68 |

*Primary Examiner*—Richard C. Pinkham
*Assistant Examiner*—William R. Browne
*Attorney, Agent, or Firm*—Chernoff & Vilhauer

[57] ABSTRACT

An adjustable apparatus for developing bending strength in the muscles of a user. The apparatus simulates the resistance encountered when attempting to bend metal bars with the arms outstretched forwardly and the hands initially in a horizontal, palms downward position, and thus develops specifically those muscles and skills required for such feats. The apparatus is formed of two U-shaped members hinged at their open ends to form an O-shaped assembly. Each U-shaped member has a handle attached near the middle of the base portions, for grasping by the user's hands. Bend-resistant lengths of fairly rigid, yet resilient, material can be added successively between the U-shaped members to obtain an increased resistance to bending pressures, thus providing a device for progressively developing strength in the sets of muscles involved in bending strength.

7 Claims, 3 Drawing Figures

MUSCLE BUILDING APPARATUS FOR DEVELOPING BENDING STRENGTH

BACKGROUND OF THE INVENTION

Apparatus utilizing the resistance of coil springs for building, toning and more clearly defining musculature of the human body is known. Common examples are chest cables, handgrips and the so-called "German horseshoe." Apparatus requiring the bending of steel coil is also known, comprising two bars with grips having a length of steel coil connecting the two bars. However, such apparatus has the disadvantage of skewing into different planes when used, thus preventing smooth pulls by the muscles involved. Moreover, such apparatus does not build true bending power, tending only to more clearly define the muscles involved.

The apparatus of the present invention specifically addresses those muscles that are used in bending, its regular use rendering them more powerful and at the same time toning and helping define them. The specific muscles involved are those in the thumbs, fingers, hands, wrists, forearms, triceps, pectorals, shoulder caps and trapezius.

SUMMARY OF THE INVENTION

It is a primary object of the present invention to provide apparatus that enables its user to gradually develop bending force in the muscles of the back, shoulders, arms, chest and hands.

It is another object of the present invention to provide apparatus that gradually builds, tones and defines muscles of the back, shoulders, arms, chest and hands.

It is still another object of the present invention to provide such apparatus in an inexpensive, easy-to-use and simple design.

These and other objects are accomplished by the provision of a generally O-shaped frame which is hinged at its midpoint, thus dividing the frame into two halves, each half being provided with a handle and means for holding one end of a multiplicity of lengths of fairly rigid yet resilient material such as steel springs.

DETAILED DESCRIPTION OF INVENTION

Figure 1:
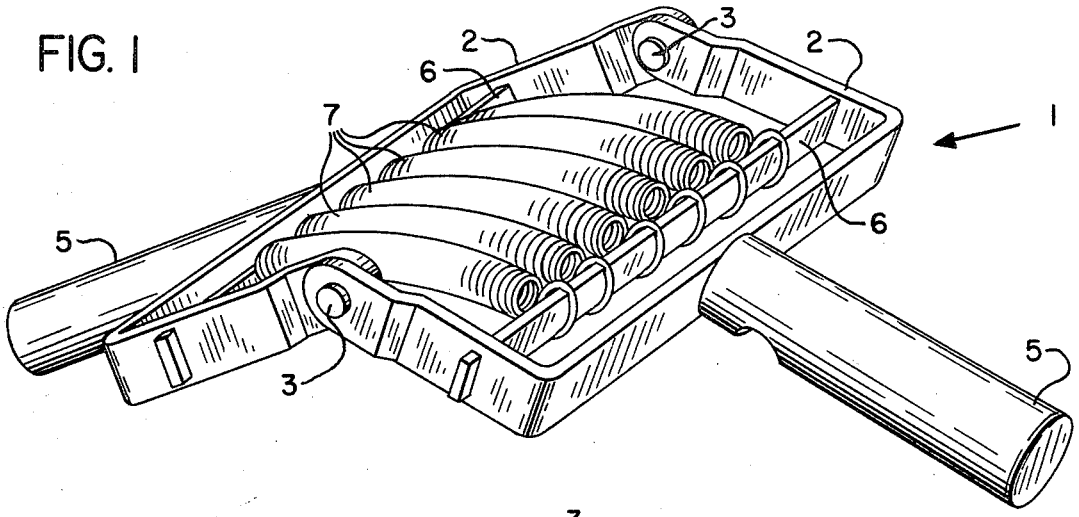
FIG. 1 is a perspective view of the apparatus of the present invention showing it in a flexed mode.
Figure 2:
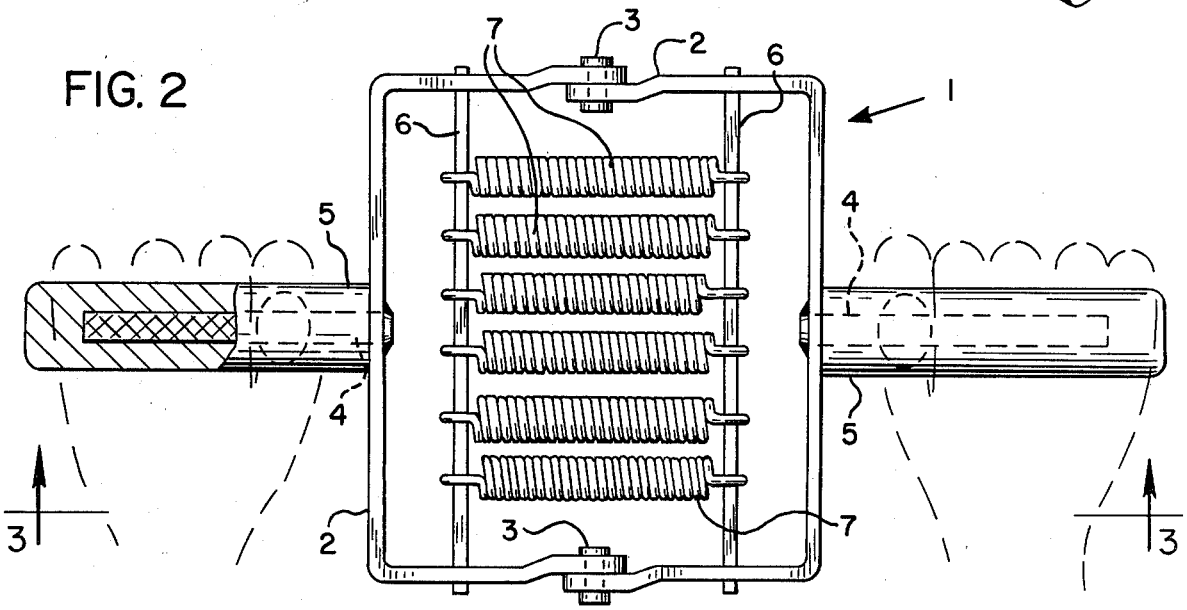
FIG. 2 is a plan view of the apparatus of the present invention showing the preferred embodiment.

Referring now to the drawings wherein like numerals indicate like elements, FIGS. 1 and 2 show the apparatus of the present invention as a generally O-shaped frame 1 comprising two U-shaped members 2 that are pivotally connected to each other at 3, each U-shaped member 2 having a handle 4, preferably with a handle grip 5, and retaining means 6 for supporting either end of fairly rigid yet resilient material such as steel springs 7.

The frame 1 is generally O-shaped, comprising two generally U-shaped members 2 that may have generally square corners as shown in FIG. 1 or radiused corners as shown in FIG. 2. It should be of rigid construction, preferably of chrome-plated tempered steel, the pivotal connection 3 being of any suitable construction.

Connected to each U-shaped member 2 at or near the midpoint of the bottom of the U is a handle 4 which may be fastened thereto by welding, bolting or tapping. The handles 4 are also preferably made of tempered steel and are knurled to more tightly secure handgrip 5. The handgrips 5 may be fabricated from wood, rubber or other suitable material and preferably have notches therein as illustrated in FIG. 1 to receive the thumbs of the user so as to relieve excessive stress on the thumb and hand muscles.

Inset within each U-shaped member is a retainer 6 for attaching the resilient material such as spring steel having notches or other fastening means adapted to detachably receive lengths of resilient material such as spring steel. The retainer 6 may be either rigidly or pivotally attached to the U-shaped member, and may be of virtually any cross-sectional shape. Any suitable arrangement will do as the retainer means, another example being in the form of eyelets (not shown).

The resilient material 7 should be fairly rigid yet flexible, such as steel coils or ribbons of spring steel and should be fabricated so as to be detachable at either end from retainer 6. In the case of steel coils, the ends are preferably in the shape of nearly closed circles to engage notches on retainer 6. In the case of flat ribbons of spring steel, each end is preferably punched with a hole in the same manner as a hacksaw blade, so as to engage corresponding male members (not shown) on retainer 6.

The amount of spring tension on each resilient member 7 may be varied to accommodate the particular level of muscle power of the user all the way from the novice to the professional body builder. The resistance of the apparatus to muscles may be gradually increased by simply adding additional lengths of resilient material; conversely, the resistance may be decreased by detaching the desired number. As power increases, the number and tension of springs may be increased to develop, strengthen and define the muscles of the thumbs, fingers, hands, wrists, forearms, triceps, pectorals, shoulder caps and the trapezius muscles. Preferably, the apparatus is provided to utilize from one to six lengths of $\frac{1}{8}$ inch coil steel $\frac{3}{4}$ inch in diameter and 6 inches long, although other lengths, diameters and strengths of steel may be used, depending upon the needs of the user.

Figure 3:
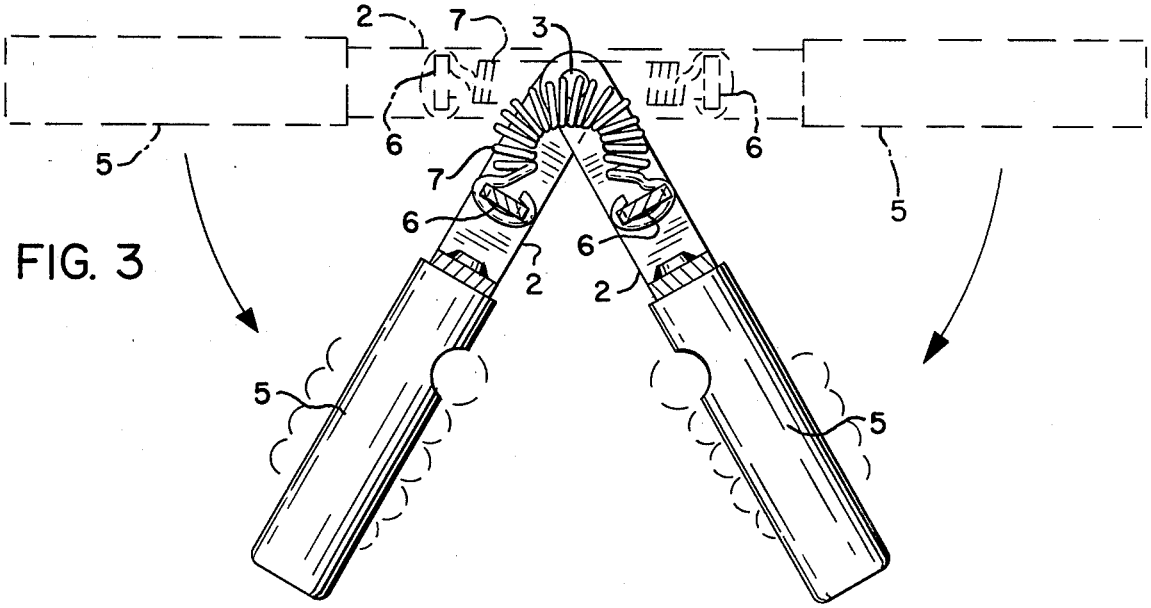
FIG. 3 is a side view of the apparatus shown in FIG. 2 taken along the line 3—3, with the rest position of the apparatus in dotted outline.

In use, one handle is grasped in each hand, palms in the horizontal position facing downward, with the apparatus in rest position as shown in dotted outline in FIG. 3. The handles are forced downward and inward along a curved path, as represented by the downward curving arrows in FIG. 3 to a flexed position as therein shown in solid outline. Resistance of the apparatus to such bending motion develops those muscles, for examples, back, shoulders, arms, chest and hands, peculiarly used in bending.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A muscle building flexing apparatus for developing bending strength comprising:

(a) a substantially O-shaped frame hinged at its midpoint so as to form two generally U-shaped members that face each other and are pivotally connected to one another;

(b) each U-shaped member having a handle rigidly connected thereto and a retainer means for releasably retaining one end of at least one of a multiplicity of lengths of fairly rigid, yet resilient material; and (c) said handles lying generally in a common plane and along a common axis prior to flexing the ends of the resilient material toward each other.

2. The apparatus of claim 1 wherein the fairly rigid yet resilient material is spring steel.

3. The apparatus of claim 2 wherein the spring steel is in the form of steel coil.

4. The apparatus of claim 2 wherein the spring steel is in the form of ribbons.

5. The apparatus of claim 1 wherein the retainer means is a bar.

6. The apparatus of claim 5 wherein the bar has connecting means for detachably engaging the fairly rigid yet resilient material.

7. The apparatus of claim 6 wherein the connecting means is in the form of notches.

* * * * *